US011060159B2

(12) United States Patent
Takebayashi et al.

(10) Patent No.: US 11,060,159 B2
(45) Date of Patent: Jul. 13, 2021

(54) GRAIN-ORIENTED ELECTRICAL STEEL SHEET AND METHOD OF MANUFACTURING GRAIN-ORIENTED ELECTRICAL STEEL SHEET

(71) Applicant: NIPPON STEEL CORPORATION, Tokyo (JP)

(72) Inventors: Seiki Takebayashi, Tokyo (JP); Shuichi Nakamura, Tokyo (JP); Hiroyasu Fujii, Tokyo (JP); Yoshiyuki Ushigami, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 4 days.

(21) Appl. No.: 16/628,951

(22) PCT Filed: Jul. 13, 2018

(86) PCT No.: PCT/JP2018/026611
§ 371 (c)(1),
(2) Date: Jan. 6, 2020

(87) PCT Pub. No.: WO2019/013347
PCT Pub. Date: Jan. 17, 2019

(65) Prior Publication Data

US 2020/0123626 A1 Apr. 23, 2020

(30) Foreign Application Priority Data

Jul. 13, 2017 (JP) ..... JP2017-137419

(51) Int. Cl.
*C23C 22/05* (2006.01)
*C23C 28/00* (2006.01)
(Continued)

(52) U.S. Cl.
CPC ..... *C21D 8/1222* (2013.01); *C21D 8/1233* (2013.01); *C21D 8/1255* (2013.01);
(Continued)

(58) Field of Classification Search
CPC .. C21D 8/1222; C21D 8/1233; C21D 8/1255; C21D 8/1283; C21D 9/46; C22C 38/00;
(Continued)

(56) References Cited

U.S. PATENT DOCUMENTS 4,698,272 A 10/1987 Inokuti et al.
4,863,531 A 9/1989 Wada et al.
(Continued)

FOREIGN PATENT DOCUMENTS

EP 0 234 669 A2 9/1987
EP 0577124 A2 1/1994
(Continued)

OTHER PUBLICATIONS

"Geometrical Product Specifications (GPS)—Surface texture: Profile method—Rules and procedures for the assessment of surface texture", JIS B 0633, 2001, total 33 pages.
(Continued)

*Primary Examiner* — Jenny R Wu
(74) *Attorney, Agent, or Firm* — Birch, Stewart, Kolasch & Birch, LLP

(57) ABSTRACT

A grain-oriented electrical steel sheet according to an aspect of the present invention includes: a steel sheet 1; an intermediate layer 4 containing Si and O, arranged on the steel sheet; and an insulation coating 3 arranged on the intermediate layer 4, in which the intermediate layer 4 contains a metal phosphide 5, a thickness of the intermediate layer 4 is 4 nm or more, and an abundance of the metal phosphide 5 present is 1% to 30% by cross-sectional area fraction in a cross section of the intermediate layer 4.

10 Claims, 3 Drawing Sheets

(51) Int. Cl.

| | |
|---|---|
| ***C22C 38/02*** | (2006.01) |
| ***C22C 38/06*** | (2006.01) |
| ***C22C 38/60*** | (2006.01) |
| ***C21D 8/12*** | (2006.01) |
| ***C21D 9/46*** | (2006.01) |
| ***C22C 38/00*** | (2006.01) |

(52) U.S. Cl.
CPC ..... *C21D 8/1283* (2013.01); *C21D 9/46* (2013.01); *C22C 38/001* (2013.01); *C22C 38/004* (2013.01); *C22C 38/02* (2013.01); *C22C 38/06* (2013.01); *C22C 38/60* (2013.01); *C23C 22/05* (2013.01); *C23C 28/00* (2013.01)

(58) Field of Classification Search
CPC ..... C22C 38/001; C22C 38/004; C22C 38/02; C22C 38/06; C22C 38/60; C23C 22/00; C23C 22/05; C23C 28/00; H01F 1/147
See application file for complete search history.

(56) References Cited

U.S. PATENT DOCUMENTS

| | | | |
|---|---|---|---|
| 5,143,561 | A | 9/1992 | Kitamura et al. |
| 2005/0112377 | A1 | 5/2005 | Schuhmacher et al. |
| 2013/0180634 | A1 | 7/2013 | Han et al. |

FOREIGN PATENT DOCUMENTS

| | | | |
|---|---|---|---|
| JP | 49-96920 | A | 9/1974 |
| JP | 62-103374 | A | 5/1987 |
| JP | 62-218582 | A | 9/1987 |
| JP | 3-130376 | A | 6/1991 |
| JP | 5-279747 | A | 10/1993 |
| JP | 6-184762 | A | 7/1994 |
| JP | 7-278833 | A | 10/1995 |
| JP | 8-191010 | A | 7/1996 |
| JP | 9-78252 | A | 3/1997 |
| JP | 11-209891 | A | 8/1999 |
| JP | 2002-322566 | A | 11/2002 |
| JP | 2002-348643 | A | 12/2002 |
| JP | 2002-363763 | A | 12/2002 |
| JP | 2003-171773 | A | 6/2003 |
| JP | 2003-313644 | A | 11/2003 |
| JP | 2004-315880 | A | 11/2004 |

OTHER PUBLICATIONS

International Search Report for PCT/JP2018/026611 dated Sep. 25, 2018.
Written Opinion of the International Searching Authority for PCT/JP2018/026611 (PCT/ISA/237) dated Sep. 25, 2018.

GRAIN-ORIENTED ELECTRICAL STEEL SHEET AND METHOD OF MANUFACTURING GRAIN-ORIENTED ELECTRICAL STEEL SHEET

TECHNICAL FIELD OF THE INVENTION

The present invention relates to a grain-oriented electrical steel sheet, and a method of manufacturing a grain-oriented electrical steel sheet.

Priority is claimed on Japanese Patent Application No. 2017-137419, filed Jul. 13, 2017, the content of which is incorporated herein by reference.

RELATED ART

A grain-oriented electrical steel sheet is a soft magnetic material, which is mainly used as a core material of a transformer, and is thus required to have magnetic characteristics such as high magnetization characteristics and low iron loss. The magnetization characteristics relate the magnetic flux density induced when a core is excited. As the magnetic flux density increases, the core can be reduced in size. Therefore, the higher the magnetization characteristics, the more advantageous in terms of the manufacturing cost of the transformer.

In order to increase the magnetization characteristics, it is necessary to evolve a texture having grains aligned in a crystal orientation (Goss orientation) in which the {110} plane is aligned parallel to the steel sheet surface and the <100> axis is aligned with the rolling direction. In order to align the crystal orientation with the Goss orientation, it is common practice to control secondary recrystallization by causing inhibitors such as AlN, MnS, and MnSe to be finely precipitated.

The iron loss is a power loss consumed as heat energy when the core is excited by an alternating magnetic field, and is required to be as low as possible from the viewpoint of energy saving. The level of iron loss is influenced by magnetic susceptibility, sheet thickness, film tension, the amount of impurities, electrical resistivity, grain size, and the like. Even at the present time with various technologies developed for electrical steel sheets, research and development for reducing iron loss to improve the magnetic characteristics are continuously performed.

Another characteristic required for the grain-oriented electrical steel sheet is a characteristic of a film and a coating formed on the surface of the steel sheet. In general, in a grain-oriented electrical steel sheet, as shown in FIG. 1, a forsterite film 2 containing $Mg_2SiO_4$ (forsterite) as a main component is formed on a steel sheet 1, and an insulation coating 3 is formed on the forsterite film 2. The forsterite film and the insulation coating electrically insulate the surface of the steel sheet, and have a function of applying tension to the steel sheet to reduce the iron loss.

The forsterite film also contains, in addition to $Mg_2SiO_4$, a small amount of impurities and additives contained in the steel sheet and an annealing separator, and reaction products thereof.

In order for the insulation coating to exhibit insulation properties and required tension, the insulation coating must not peel from the steel sheet, and therefore, the insulation coating is required to have high coating adhesion. However, it is not easy to simultaneously increase both the tension applied to the steel sheet and the coating adhesion, and research and development to simultaneously increase the tension applied to the steel sheet and the coating adhesion are continuously carried out.

The grain-oriented electrical steel sheet is typically manufactured by the following procedure. A silicon steel slab containing 2.0 to 4.0 mass % of Si is hot-rolled into a hot-rolled steel sheet, and the hot-rolled steel sheet is subjected to annealing as necessary, then subjected to one time or two or more times of cold rolling with intermediate annealing therebetween, and finished to a steel sheet having a final thickness. Thereafter, decarburization annealing is performed on the steel sheet having the final thickness in a wet hydrogen atmosphere to promote primary recrystallization in addition to decarburization and to form an oxide layer on the surface of the steel sheet.

An annealing separator containing MgO (magnesia) as a main component is applied to the steel sheet having the oxide layer, and dried. After the drying, the resultant is wound into a coil. Next, final annealing is performed on the coiled steel sheet to promote secondary recrystallization to align grains in the Goss orientation and further cause MgO in the annealing separator and $SiO_2$ (silicon oxide or silica) in the oxide layer to react with each other, whereby an inorganic forsterite film containing $Mg_2SiO_4$ as a main component is formed on the surface of the steel sheet.

Next, purification annealing is performed on the steel sheet having the forsterite film to cause impurities in the steel sheet to be diffused to the outside and removed. Furthermore, by flattening annealing the steel sheet, an insulation coating containing a phosphate and colloidal silica as a main component is formed on the surface of the steel sheet. At this time, tension is applied between the steel sheet and the insulation coating due to the difference in thermal expansion coefficient therebetween.

The interface between the forsterite film ("2" in FIG. 1) containing $Mg_2SiO_4$ as a main component and the steel sheet ("1" in FIG. 1) typically has an uneven shape which is not uniform (see FIG. 1), and the uneven shape of the interface slightly deteriorates the iron loss reduction effect due to tension. In order to reduce the iron loss by smoothing the interface, the following developments have been carried out up to the present.

Patent Document 1 discloses a manufacturing method in which a forsterite film is removed by pickling or the like, and the surface of a steel sheet is smoothened by chemical polishing or electrolytic polishing. However, in the manufacturing method of Patent Document 1, there is a problem that an insulation coating is difficult to adhere to the surface of the base metal.

Therefore, in order to increase the coating adhesion of the insulation coating to the smooth surface of the steel sheet, as shown in FIG. 2, forming an intermediate layer 4 (or base material coating) between the steel sheet and the insulation coating is suggested. The base material coating formed by applying an aqueous solution of a phosphate or alkali metal silicate disclosed in Patent Document 2 is also effective for coating adhesion. However, as a more effective method, Patent Document 3 discloses a method of annealing a steel sheet in a specific atmosphere before forming an insulation coating to form an externally oxidized silica layer as an intermediate layer on the surface of the steel sheet.

Furthermore, Patent Document 4 discloses a method of forming 100 mg/m$^2$ or less of an externally oxidized silica layer as an intermediate layer on the surface of a steel sheet before forming an insulation coating. Patent Document 5 discloses a method of forming an externally oxidized layer such as a silica layer as an intermediate layer when an insulation coating is a crystalline insulation coating containing a boric acid compound and an alumina sol as a main component.

These externally oxidized silica layers are formed as an intermediate layer on the surface of the steel sheet, function as a base material of the smooth interface, and exhibits a certain effect in improving the coating adhesion of the insulation coating. However, further development is under way to more reliably secure the adhesion of the insulation coating formed on the externally oxidized silica layer.

Patent Document 6 discloses a method of performing a heat treatment on a steel sheet having a smooth surface in an oxidizing atmosphere to form a crystalline intermediate layer of $Fe_2SiO_4$ (fayalite) or $(Fe,Mn)_2SiO_4$ (knebelite) on the surface of the steel sheet, and thereafter forming an insulation coating thereon.

However, in the oxidizing atmosphere in which $Fe_2SiO_4$ or $(Fe,Mn)_2SiO_4$ is formed on the surface of the steel sheet, Si in the surface layer of the steel sheet is oxidized and an oxide such as $SiO_2$ is precipitated, so that there is a problem that iron loss characteristics deteriorate.

In addition, there is a problem that due to the difference in crystal structure, the adhesion between the intermediate layer and the insulation coating is not stable.

Furthermore, there is also a problem that the tension applied to the surface of the steel sheet by the intermediate layer containing $Fe_2SiO_4$ or $(Fe,Mn)_2SiO_4$ as a main component is not as large as the tension applied to the surface of the steel sheet by the intermediate layer containing $SiO_2$ as a main component.

Patent Document 7 discloses a method of forming a gel film having a thickness of 0.1 to 0.5 μm as an intermediate layer on the smooth surface of a steel sheet by a sol-gel method, and forming an insulation coating on the intermediate layer. However, the disclosed film forming conditions fall within the range of a general sol-gel method, and the coating adhesion may not be firmly secured.

Patent Document 8 discloses a method of forming a siliceous coating as an intermediate layer on the smooth surface of a steel sheet by an anodic electrolytic treatment in an aqueous solution of silicate and thereafter forming an insulation coating.

Patent Document 9 discloses an electrical steel sheet in which an oxide such as $TiO_2$ (an oxide of one or more selected from the group consisting of Al, Si, Ti, Cr, and Y) is included in the form of layers or islands on the smooth surface of a steel sheet, a silica layer is included thereon, and an insulation coating is further included thereon.

By forming such an intermediate layer, it is possible to improve the coating adhesion. However, since large facilities such as an electrolytic treatment facility or a dry coating facility are newly required, problems in securing the site and economic problems remain.

Patent Document 10 discloses a grain-oriented silicon steel sheet in which an externally oxidized granular oxide containing silica as a main component is provided in addition to an externally oxidized layer containing silica as a main component with a thickness of 2 to 500 nm at the interface between a tension-applying insulation coating and a steel sheet, and Patent Document 11 also discloses a grain-oriented silicon steel sheet in which an externally oxidized layer containing silica as a main component is provided with voids in a cross-sectional area fraction of 30% or less.

Patent Document 12 discloses a method of forming, on the smooth surface of a steel sheet, an externally oxidized layer containing $SiO_2$ as a main component, which has a thickness of 2 to 500 nm and contains metal iron in a cross-sectional area fraction of 30% or less, as an intermediate layer, and forming an insulation coating on the intermediate layer.

Patent Document 13 discloses a method of forming, on the smooth surface of a steel sheet, an intermediate layer containing vitreous silicon oxide as a main component, which has a thickness of 0.005 to 1 μm and contains metal iron or an iron-containing oxide in a volume fraction of 1% to 70%, and forming an insulation coating on the intermediate layer.

Patent Document 14 discloses a method of forming, on the smooth surface of a steel sheet, an externally oxidized layer containing $SiO_2$ as a main component, which has a thickness of 2 to 500 nm and contains a metal oxide (Si—Mn—Cr oxide, Si—Mn—Cr—Al—Ti oxide, or Fe oxide) in a cross-sectional area fraction of 50% or less, as an intermediate layer, and forming an insulation coating on the intermediate layer.

As described above, when the intermediate layer containing $SiO_2$ as a main component contains externally granular oxides, voids, metal iron, iron-containing oxides, or metal oxides, the coating adhesion of the insulation coating is improved to some extent, but further improvement is expected.

PRIOR ART DOCUMENT

Patent Document

[Patent Document 1] Japanese Unexamined Patent Application, First Publication No. S49-096920

[Patent Document 2] Japanese Unexamined Patent Application, First Publication No. H05-279747

[Patent Document 3] Japanese Unexamined Patent Application, First Publication No. H06-184762

[Patent Document 4] Japanese Unexamined Patent Application, First Publication No. H09-078252

[Patent Document 5] Japanese Unexamined Patent Application, First Publication No. H07-278833

[Patent Document 6] Japanese Unexamined Patent Application, First Publication No. H08-191010

[Patent Document 7] Japanese Unexamined Patent Application, First Publication No. H03-130376

[Patent Document 8] Japanese Unexamined Patent Application, First Publication No. H11-209891

[Patent Document 9] Japanese Unexamined Patent Application, First Publication No. 2004-315880

[Patent Document 10] Japanese Unexamined Patent Application, First Publication No. 2002-322566

[Patent Document 11] Japanese Unexamined Patent Application, First Publication No. 2002-363763

[Patent Document 12] Japanese Unexamined Patent Application, First Publication No. 2003-313644

[Patent Document 13] Japanese Unexamined Patent Application, First Publication No. 2003-171773

[Patent Document 14] Japanese Unexamined Patent Application, First Publication No. 2002-348643

DISCLOSURE OF THE INVENTION

Problems to be Solved by the Invention

Typically, the layering structure of a grain-oriented electrical steel sheet having no forsterite film has a three-layer structure of "steel sheet-intermediate layer-insulation coating", and the interface form between the steel sheet and the insulation coating is macroscopically uniform and smooth (see FIG. 2). After a heat treatment, surface tension acts between the layers due to the difference in thermal expansion coefficient between the layers, so that tension can be applied to the steel sheet, while the layers are easily separated.

Therefore, an object of the present invention is to form an intermediate layer containing silicon oxide as a main component (that is, an intermediate layer containing Si and O) capable of securing excellent coating adhesion of an insulation coating without unevenness, and to provide a grain-oriented electrical steel sheet and a method of manufacturing the same to solve the problems.

Means for Solving the Problem

In the related art, in order to cause the coating adhesion of an insulation coating to be uniform, it is common practice to form an intermediate layer containing silicon oxide as a main component on the smooth surface of a steel sheet more uniformly and smoothly. However, the present inventors intensively studied methods to solve the problems regardless of common practice.

As a result, it was found that in a layering structure of three-layer, when an intermediate layer containing silicon oxide as a main component and containing a metal phosphide is formed on the surface of a grain-oriented electrical steel sheet in which a forsterite film is removed after manufacturing, or on the surface of a grain-oriented electrical steel sheet in which the generation of a forsterite film is inhibited, an insulation coating can secure excellent coating adhesion without unevenness.

The present invention has been made based on the above findings, and the gist thereof is as follows.

(1) A grain-oriented electrical steel sheet according to an aspect of the present invention is a grain-oriented electrical steel sheet including: a steel sheet; an intermediate layer containing Si and O, arranged on the steel sheet; and an insulation coating arranged on the intermediate layer, in which the intermediate layer contains a metal phosphide, a thickness of the intermediate layer is 4 nm or more, and an abundance of the metal phosphide included is 1% to 30% by cross-sectional area fraction in a cross section of the intermediate layer.

(2) In the grain-oriented electrical steel sheet according to (1), the metal phosphide may be a Fe phosphide which is one or more selected from the group consisting of $Fe_3P$, $Fe_2P$, and FeP.

(3) In the grain-oriented electrical steel sheet according to (1) or (2), the intermediate layer may contain α-Fe and/or iron silicate in addition to the metal phosphide.

(4) In the grain-oriented electrical steel sheet according to (3), a total abundance of the metal phosphide, and the α-Fe and/or the iron silicate included may be 1% to 30% by cross-sectional area fraction in the cross section of the intermediate layer.

(5) In the grain-oriented electrical steel sheet according to any one of (1) to (4), the thickness of the intermediate layer may be less than 400 nm.

(6) In the grain-oriented electrical steel sheet according to any one of (1) to (5), a thickness of the insulation coating may be 0.1 to 10 μm.

(7) In the grain-oriented electrical steel sheet according to any one of (1) to (6), a surface roughness of the steel sheet may be 0.5 μm or less by arithmetic average roughness Ra.

(8) A method of manufacturing a grain-oriented electrical steel sheet according to another aspect of the present invention is a method of manufacturing the grain-oriented electrical steel sheet according to any one of (1) to (7), and includes: hot rolling a steel piece to obtain a hot-rolled steel sheet; cold rolling the hot-rolled steel sheet to obtain a cold-rolled steel sheet; decarburization annealing the cold-rolled steel sheet to form an oxide layer on a surface of the cold-rolled steel sheet; applying an annealing separator onto the surface of the cold-rolled steel sheet having the oxide layer; drying the annealing separator and winding the cold-rolled steel sheet; final annealing the wound cold-rolled steel sheet; applying a first solution; further annealing the cold-rolled steel sheet to which the first solution is applied to form an intermediate layer containing a metal phosphide; applying a second solution on a surface of the intermediate layer; and baking the cold-rolled steel sheet to which the second solution is applied, in which the first solution contains phosphoric acid and a metal compound, and a mass ratio between the phosphoric acid and the metal compound is 2:1 to 1:2, in the annealing for forming the intermediate layer, an annealing temperature is 600° C. to 1150° C., an annealing time is 10 to 600 seconds, a dew point in an annealing atmosphere is −20° C. to 2° C., and a ratio between an amount of hydrogen and an amount of nitrogen in the annealing atmosphere is 75%:25%, and an application amount of the first solution is controlled such that an abundance of the metal phosphide included is 1% to 30% by cross-sectional area fraction in a cross section of the intermediate layer.

(9) The method of manufacturing the grain-oriented electrical steel sheet according to (8) may further include: removing an inorganic mineral material film generated during the final annealing before the applying of the first solution, in which the annealing separator may contain magnesia as a main component.

(10) The method of manufacturing the grain-oriented electrical steel sheet according to (8) or (9) may further include: annealing the hot-rolled steel sheet before the cold rolling.

Effects of the Invention

According to the present invention, it is possible to provide a grain-oriented electrical steel sheet in which an intermediate layer containing silicon oxide as a main component, which contains a metal phosphide and contains as appropriate α-Fe and/or iron silicate as appropriate, and can secure excellent coating adhesion of an insulation coating without unevenness, is provided on the entire surface of the steel sheet, and a method of manufacturing the same.

EMBODIMENTS OF THE INVENTION

A grain-oriented electrical steel sheet having excellent coating adhesion according to an aspect of the present invention (hereinafter sometimes referred to as "electrical steel sheet" according to the present embodiment) is a grain-oriented electrical steel sheet in which an insulation coating is formed on an intermediate layer containing silicon oxide as a main component formed on the surface of the steel sheet (that is, an intermediate layer containing Si and O). Specifically, in a grain-oriented electrical steel sheet including an intermediate layer containing silicon oxide as a main component on the surface of a grain-oriented electrical steel sheet having no forsterite film on the surface and an insulation coating containing a phosphate and colloidal silica as a main component on the intermediate layer, the intermediate layer contains a metal phosphide, the thickness of the intermediate layer is 4 nm or more, and the abundance of the metal phosphide included is 1% to 30% by cross-sectional area fraction in a cross section of the intermediate layer. In other words, the electrical steel sheet according to the present embodiment includes a steel sheet 1, an intermediate layer 4 containing Si and O, arranged on the steel sheet 1, and an insulation coating 3 arranged on the intermediate layer 4, in which the intermediate layer 4 contains a metal phosphide 5, the thickness of the intermediate layer 4 is 4 nm or more, and the abundance of the metal phosphide 5 included is 1% to 30% by cross-sectional area fraction in a cross section of the intermediate layer 4.

Here, the grain-oriented electrical steel sheet having no forsterite film on the surface is a grain-oriented electrical steel sheet in which a forsterite film is removed after manufacturing, or a grain-oriented electrical steel sheet in which the generation of a forsterite film is suppressed.

Hereinafter, the electrical steel sheet of the present embodiment will be described.

Figure 3:
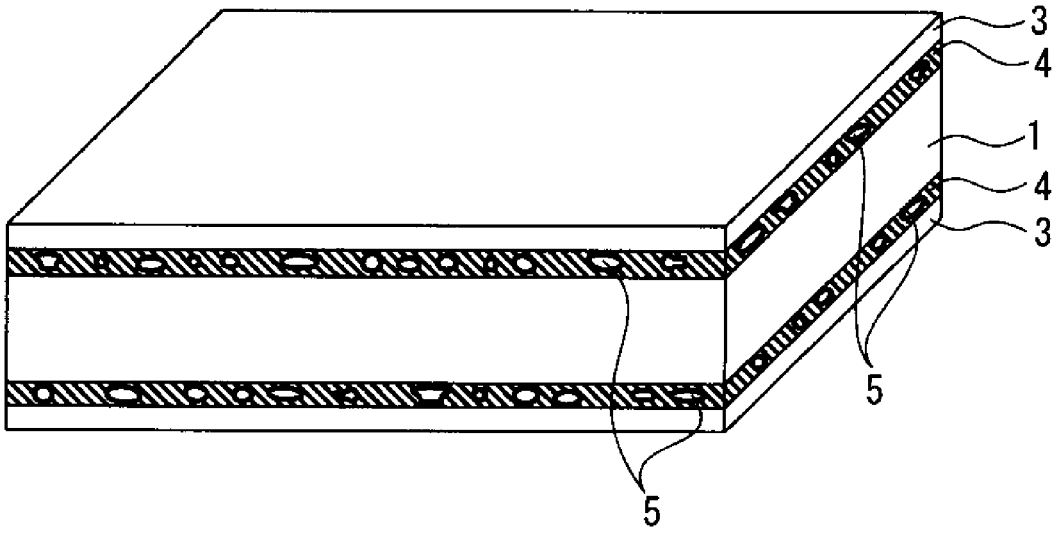
FIG. 3 is a view schematically showing a layering structure of a grain-oriented electrical steel sheet of the present invention.

The layering structure of the electrical steel sheet of the present invention is schematically shown in FIG. 3. As shown in FIG. 3, the intermediate layer 4 containing silicon oxide as a main component and containing the metal phosphide 5 is formed on the surface of the steel sheet 1, and the insulation coating 3 is formed thereon. The intermediate layer 4 containing silicon oxide as a main component may contain α-Fe and/or iron silicate in addition to the metal phosphide 5. The details will be described below.

Insulation Coating

The insulation coating is an insulation coating formed by applying a solution containing a phosphate and colloidal silica ($SiO_2$) as a main component onto the intermediate layer containing silicon oxide as a main component and baking the solution. This insulation coating can apply high surface tension to the steel sheet.

However, when the thickness of the insulation coating is less than 0.1 μm, it becomes difficult to apply the required surface tension to the steel sheet. Therefore, the thickness of the insulation coating is preferably 0.1 μm or more. The thickness thereof is more preferably 0.5 μm or more, 0.8 μm or more, 1.0 μm or more, or 2.0 μm or more. On the other hand, when the thickness of the insulation coating exceeds 10 μm, there is concern that cracks may be generated in the insulation coating at the stage of forming the insulation coating. Therefore, the thickness of the insulation coating is preferably 10 μm or less. The thickness thereof is more preferably 5 μm or less, 4.5 μm or less, 4.2 μm or less, or 4.0 μm or less.

As necessary, magnetic domain refinement treatment may be applied to the insulation coating to apply local microstrain by laser, plasma, mechanical methods, etching, or other methods.

Intermediate Layer Containing Silicon Oxide as a Main Component

Figure 2:
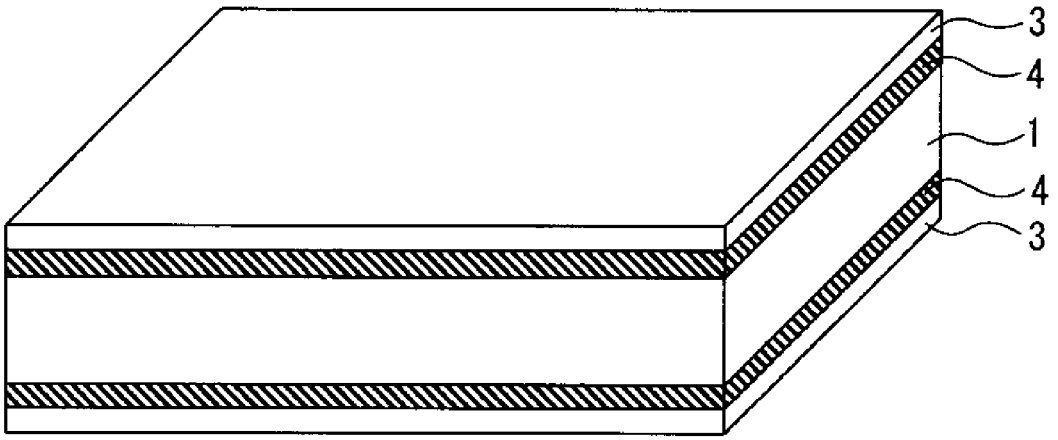
FIG. 2 is a view schematically showing another layering structure of a grain-oriented electrical steel sheet in the related art.

The intermediate layer according to the present embodiment contains Si and O, and further contains the metal phosphide. The intermediate layer according to the present embodiment may further contain impurities. Such an intermediate layer is called an intermediate layer containing silicon oxide as a main component in the present embodiment. In the layering structure of the three-layer structure (see FIG. 2), the intermediate layer containing silicon oxide as a main component has a function of bringing the steel sheet and the insulation coating into close contact. However, it has not hitherto been easy to form the intermediate layer containing silicon oxide as a main component on the entire surface of the steel sheet by being firmly adhered with uniform adhesion without unevenness.

Therefore, the present inventors thought that by causing the intermediate layer to be not an intermediate layer containing only silicon oxide but an intermediate layer in which silicon oxide and a crystalline material are combined, the intermediate layer and the steel sheet are firmly adhered to each other with uniform adhesion without unevenness, and formed an intermediate layer containing silicon oxide as a main component and containing various crystalline materials on the surface of a steel sheet to test the adhesion between the intermediate layer and the steel sheet.

As a result, it was found that an intermediate layer containing silicon oxide as a main component and containing a metal phosphide firmly adheres to the entire surface of a steel sheet. It is considered that the reason is that the flexibility of the intermediate layer is improved by the irregular shape of the metal phosphide included in the intermediate layer containing silicon oxide as a main component.

Figure 1:
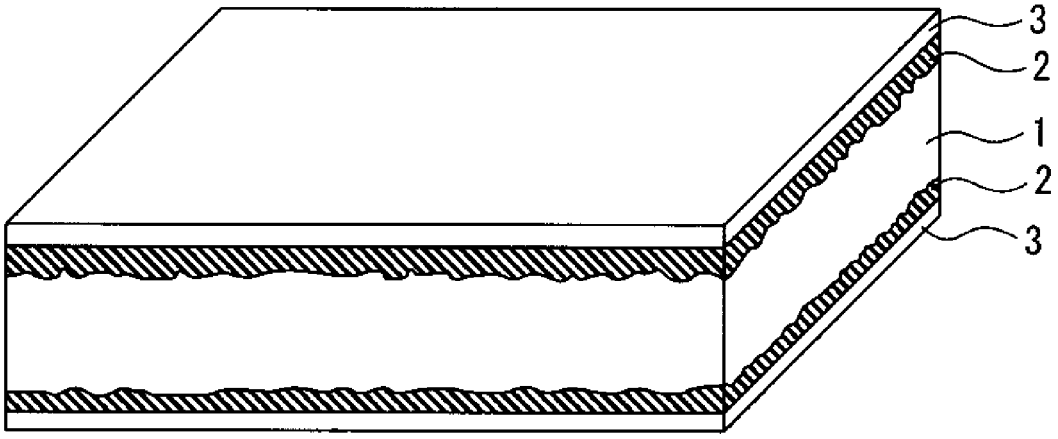
FIG. 1 is a view schematically showing a layering structure of a grain-oriented electrical steel sheet in the related art.

Typically, in a grain-oriented electrical steel sheet, as shown in FIG. 1, a forsterite film 2 containing $Mg_2SiO_4$ (forsterite) as a main component is formed on a steel sheet 1, and the interface between the forsterite film 2 and the steel sheet 1 has an uneven shape which is not uniform (see FIG. 1). The uneven shape of the interface, which is evaluated by the surface roughness, greatly contributes to the adhesion between the steel sheet and the insulation coating, and it is necessary to increase the surface roughness in order to improve the adhesion between the steel sheet and the insulation coating. However, in the grain-oriented electrical steel sheet according to the present embodiment, it is considered that the improvement in the flexibility of the intermediate layer containing silicon oxide as a main component greatly affects the improvement in the adhesion between the steel sheet and the insulation coating. Therefore, the surface roughness of the steel sheet on which the intermediate layer is formed is not particularly limited to a specific range. From the viewpoint of improving adhesion, which is an object of the invention, the surface roughness is preferably large. However, from the viewpoint of applying a large tension to the steel sheet and achieving a reduction in iron loss, the surface roughness (Ra) is preferably 0.5 μm or less and more preferably 0.3 μm or less by arithmetic average roughness (Ra). In the grain-oriented electrical steel sheet according to the present embodiment, even if the surface of the steel sheet is smooth, the intermediate layer according to the present embodiment can secure the adhesion of the insulation coating.

The thickness of the steel sheet is also not particularly limited to a specific range. However, in order to further reduce the iron loss, the thickness is preferably 0.35 mm or less, and more preferably 0.30 mm or less.

In the intermediate layer containing silicon oxide as a main component and containing the metal phosphide (hereinafter sometimes referred to as the "intermediate layer according to the present embodiment"), the silicon oxide is preferably $SiO_x$ (x=1.0 to 2.0). In a case of x=1.5 to 2.0, silicon oxide becomes more stable, which is more preferable. When oxidation annealing for forming the intermediate layer according to the present embodiment is sufficiently performed, $SiO_x$ with x≈2.0 can be formed.

When the oxidation annealing is performed at a normal temperature (1150° C. or less), the intermediate layer according to the present invention having dense material characteristics, capable of having high strength to withstand thermal stress and easily relaxing thermal stress due to relatively small elasticity, can be formed on the surface of the steel sheet.

The steel sheet contains a high concentration of Si (for example, 0.80 to 4.00 mass %), and has a strong chemical affinity with the intermediate layer according to the present embodiment, and then the intermediate layer according to the present embodiment and the steel sheet firmly adhere to each other.

When the thickness of the intermediate layer according to the present embodiment is small, the thermal stress relaxation effect is not sufficiently exhibited, and therefore, the thickness of the intermediate layer according to the present embodiment is 4 nm or more. The thickness thereof is preferably 5 nm or more, 10 nm or more, 20 nm or more, or 50 nm or more. On the other hand, the upper limit of the intermediate layer according to the present embodiment is not limited as long as the thickness is uniform and there is no defect such as voids or cracks. However, when the thickness is too large, there is concern that the thickness may become uneven or defects such as voids and cracks may be incorporated. Therefore, the thickness of the intermediate layer according to the present embodiment is preferably less than 400 nm. The thickness thereof is more preferably 300 nm or less, 250 nm or less, 200 nm or less, or 100 nm or less.

The metal phosphide contained in the intermediate layer according to the present embodiment is preferably one or more selected from the group consisting of Fe phosphides of $Fe_3P$, $Fe_2P$, and FeP. Since Fe is a constituent element of the steel sheet, it is considered that $Fe_3P$, $Fe_2P$, and FeP among metal phosphides greatly contribute to the improvement in the adhesion between the intermediate layer according to the present embodiment and the steel sheet.

The abundance of the metal phosphide included in the intermediate layer according to the present embodiment is indicated by the ratio of the total cross-sectional area (hereinafter sometimes referred to as "cross-sectional area fraction") of the metal phosphide to the cross-sectional area of the entire intermediate layer containing the metal phosphide.

When the cross-sectional area fraction of the metal phosphide is small (the abundance is small), the metal phosphide does not contribute to the improvement in the flexibility of the intermediate layer, and the required adhesion for the steel sheet is not obtained. Therefore, the cross-sectional area fraction is preferably 1% or more. The cross-sectional area fraction thereof is more preferably 2% or more, 5% or more, 10% or more, or 15% or more.

On the other hand, when the cross-sectional area ratio of the metal phosphide is large (the abundance is large), the proportion of silicon oxide decreases and the adhesion between the intermediate layer and the insulation coating decreases. Therefore, the cross-sectional area fraction is preferably 30% or less. The cross-sectional area fraction thereof is more preferably 27% or less, 25% or less, 20% or less, or 18% or less.

The intermediate layer according to the present embodiment may contain α-Fe and/or iron silicate in addition to the metal phosphide. α-Fe is iron having a ferrite phase and is a main constituent element of the steel sheet. Iron silicate is crystalline $Fe_2SiO_4$ (fayalite) that is generated when the steel sheet is subjected to oxidation annealing, and may contain a small amount of $FeSiO_3$ (ferrosilite).

It is considered that due to the presence of α-Fe which is a main constituent element of the steel sheet and/or iron silicate which has a chemical affinity with the steel sheet in the intermediate layer containing silicon oxide as a main component according to the present embodiment, the thermal sensitivity of the intermediate layer approaches the thermal sensitivity of the steel sheet, and thus the flexibility of the intermediate layer is improved, resulting in the improvement in the adhesion between the intermediate layer and the steel sheet. However, even when the intermediate layer contains α-Fe and/or iron silicate, the abundance of the metal phosphide included in the intermediate layer has to be 1% to 30% by cross-sectional area fraction as described above.

The abundance of the "metal phosphide, and α-Fe and/or iron silicate" included in the intermediate layer according to the present embodiment is indicated by the ratio of the total cross-sectional area (total cross-sectional area fraction) of the "metal phosphide, and α-Fe and/or iron silicate" to the cross-sectional area of the entire intermediate layer containing the "metal phosphide, and α-Fe and/or iron silicate".

Even when the intermediate layer contains α-Fe and/or iron silicate, the abundance of the metal phosphide included in the intermediate layer has to be 1% to 30% by cross-sectional area fraction. In addition, α-Fe and/or iron silicate is not an essential component of the intermediate layer according to the present embodiment. Therefore, the total cross-sectional area fraction of the "metal phosphide, and α-Fe and/or iron silicate" is 1% or more. More preferably, the total cross-sectional area fraction of the "metal phosphide, and α-Fe and/or iron silicate" is 2% or more, 5% or more, 10% or more, or 15% or more.

On the other hand, when the total cross-sectional area of the "metal phosphide, and α-Fe and/or iron silicate" is large (the abundance is large), the proportion of silicon oxide in the intermediate layer decreases and the adhesion between the intermediate layer and the insulation coating decreases. Therefore, the total cross-sectional area fraction is preferably 30% or less. The total cross-sectional area fraction thereof is more preferably the 27% or less, 25% or less, 20% or less, or 18% or less.

When the grain sizes (average value of equivalent circle diameter) of the "metal phosphide, and α-Fe and/or iron silicate" included in the intermediate layer according to the present embodiment are small, the operational effect of relaxing thermal stress decreases. Therefore, the grain size is preferably 1 nm or more. The grain size thereof is more preferably 3 nm or more.

On the other hand, when the grain sizes of the "metal phosphide, and α-Fe and/or iron silicate" are large, the "metal phosphide, and α-Fe and/or iron silicate" may become a fracture origin due to stress concentration. Therefore, the grain size is preferably ⅔ or less of the thickness of the intermediate layer containing silicon oxide as a main component and containing the "metal phosphide, and α-Fe and/or iron silicate". The grain size thereof is more preferably ½ or less of the thickness of the intermediate layer.

The feature of the electrical steel sheet according to the present embodiment is the intermediate layer containing silicon oxide as a main component and containing the metal phosphide as well as α-Fe and/or iron silicate as appropriate and is not directly related to the composition of the base steel sheet, so that the composition of the electrical steel sheet according to the present embodiment is not particularly limited. However, since the grain-oriented electrical steel sheet according to the present embodiment is manufactured through various processes, preferable compositions of a base steel piece (slab) and the steel sheet 1 (base steel sheet) for manufacturing the electrical steel sheet according to the present embodiment will be described. Hereinafter, % related to the composition means mass %.

Composition of Base Steel Sheet

The base steel sheet of the electrical steel sheet according to the present embodiment contains, for example, Si: 0.8% to 7.0%, C: 0.005% or less, N: 0.005% or less, S+Se: 0.005% or less, acid-soluble Al: 0.005% or less, and a remainder consisting of Fe and impurities.

Si: 0.8% to 7.0%

Si (silicon) increases the electric resistance of the grain-oriented electrical steel sheet and reduces the iron loss. The Si content is preferably 0.8% or more, and more preferably 2.0% or more. On the other hand, when the Si content exceeds 7.0%, the saturation magnetic flux density of the base steel sheet decreases, which makes it difficult to reduce the size of the core by being used at a high magnetic flux density. For the above reason, the Si content is preferably 7.0% or less.

C: 0.005% or Less

C (carbon) forms a compound in the base steel sheet and degrades the iron loss, so that the amount thereof is preferably small. The C content is preferably limited to 0.005% or less. The C content is preferably 0.004% or less, and more preferably 0.003% or less. Since the amount of C is preferably small, the lower limit thereof includes 0%. However, when C is reduced to less than 0.0001% in amount, the manufacturing costs significantly increase. Therefore, a practical lower limit thereof is 0.0001% in terms of manufacturing.

N: 0.005% or Less

N (nitrogen) forms a compound in the base steel sheet and degrades the iron loss, so that the amount thereof is preferably small. The N content is preferably limited to 0.005% or less. The upper limit of the N content is preferably 0.004%, and more preferably 0.003%. Since the amount of N is preferably small, the lower limit thereof may be 0%.

Sum of S and Se: 0.005% or Less

S (sulfur) and Se (selenium) form a compound in the base steel sheet and degrade the iron loss, so that the amount thereof is preferably small. The amount of each of S and Se is preferably 0.005% or less, and furthermore, the sum of S and Se is also preferably limited to 0.005% or less. The amount of each of S and Se is more preferably 0.004% or less, and more preferably 0.003% or less. Since the amount thereof is preferably small, the lower limit of the amount of each of S and Se may be 0%.

Acid-Soluble Al: 0.005% or Less

Acid-soluble Al (acid-soluble aluminum) forms a compound in a base steel sheet and degrades the iron loss, so that the amount thereof is preferably small. The amount of the acid-soluble Al is preferably 0.005% or less. The amount of the acid-soluble Al is more preferably 0.004% or less, and more preferably 0.003% or less. Since the amount of the acid-soluble Al is preferably small, the lower limit thereof may be 0%.

The remainder of the composition of the above-described base steel sheet consists of Fe and impurities. The term "impurities" refers to those incorporated from ore as a raw material, scrap, manufacturing environments, and the like when steel is industrially manufactured.

Furthermore, the base steel sheet of the electrical steel sheet according to the present embodiment may contain, instead of a portion of Fe as the remainder, as optional elements, for example, at least one selected from Mn (manganese), Bi (bismuth), B (boron), Ti (titanium), Nb (niobium), V (vanadium), Sn (tin), Sb (antimony), Cr (chromium), Cu (copper), P (phosphorus), Ni (nickel), and Mo (molybdenum) within the range that does not inhibit the characteristics.

The amounts of the optional elements described above may be, for example, as follows. The lower limit of the optional elements is not particularly limited, and the lower limit may be 0%. Moreover, even if these optional elements are contained as impurities, the effect of the electrical steel sheet according to the present embodiment is not impaired.

Mn: 0% or more and 0.15% or less,
Bi: 0% or more and 0.010% or less,
B: 0% or more and 0.080% or less,
Ti: 0% or more and 0.015% or less,
Nb: 0% or more and 0.20% or less,
V: 0% or more and 0.15% or less,
Sn: 0% or more and 0.30% or less,
Sb: 0% or more and 0.30% or less,
Cr: 0% or more and 0.30% or less,
Cu: 0% or more and 0.40% or less,
P: 0% or more and 0.50% or less,
Ni: 0% or more and 1.00% or less, and
Mo: 0% or more and 0.10% or less.

Preferable Composition of Base Steel Piece (Slab)

C (carbon) is an element effective in controlling a primary recrystallization texture, so that the C content is preferably 0.005% or more. The C content is more preferably 0.02%, more preferably 0.04%, and even more preferably 0.05% or more. When the amount of C exceeds 0.085%, decarburization does not proceed sufficiently in a decarburization process, and the required magnetic characteristics cannot be obtained, so that the amount of C is preferably 0.085% or less. The amount thereof is more preferably 0.065% or less.

When the amount of Si (silicon) is less than 0.80%, austenitic transformation occurs during final annealing, and alignment of grains in the Goss orientation is inhibited, so that the amount of Si is preferably 0.80% or more. On the other hand, when the amount of Si exceeds 4.00%, the steel sheet is hardened, the workability is deteriorated, and it is difficult to perform cold rolling, so that it is necessary to cope with facilities for warm rolling and the like. From the viewpoint of workability, the amount of Si is preferably 4.00% or less. The amount thereof is more preferably 3.80% or less.

When the amount of Mn (manganese) is less than 0.03%, toughness decreases, and cracking easily occurs during hot rolling. Therefore, the amount of Mn is preferably 0.03% or more. The amount thereof is more preferably 0.06% or more. On the other hand, when the amount of Mn exceeds 0.15%, a large amount of MnS and/or MnSe are generated nonuniformly, and secondary recrystallization does not stably proceed, so that the amount of Mn is preferably 0.15% or less. The amount thereof is more preferably 0.13% or less.

When the amount of the acid-soluble Al (acid-soluble aluminum) is less than 0.010%, the precipitation amount of AlN that functions as an inhibitor is insufficient, and secondary recrystallization does not stably and sufficiently proceed, so that the amount of the acid-soluble Al is preferably 0.010% or more. The amount thereof is more preferably 0.015% or more. On the other hand, when the amount of the acid-soluble Al exceeds 0.065%, AlN is coarsened and the function thereof as an inhibitor decreases. Therefore, the amount of the acid-soluble Al is preferably 0.065% or less. The amount thereof is more preferably 0.060% or less.

When the amount of N is less than 0.004%, the precipitation amount of AlN functioning as an inhibitor is insufficient, and secondary recrystallization does not stably and sufficiently proceed, so that the amount of N is preferably 0.004% or more. The amount thereof is more preferably 0.006% or more. On the other hand, when the amount of N exceeds 0.015%, a large amount of nitrides are precipitated nonuniformly during hot rolling, which disturbs the progress of recrystallization. Therefore, the amount of N is preferably 0.015% or less. The amount thereof is more preferably 0.013% or less.

When the amount of one of S and Se or the sum of the two is less than 0.005%, the precipitation amount of MnS and/or MnSe functioning as an inhibitor is insufficient, and secondary recrystallization does not stably and sufficiently proceed, so that the amount of one of S and Se or the sum of the two is preferably 0.005% or more. The amount thereof is more preferably 0.007% or more. On the other hand, when the amount thereof exceeds 0.050%, purification is insufficient during final annealing and iron loss characteristics decrease. Therefore, the amount of one of S and Se or the sum of the two is preferably 0.050% or less. The amount thereof is more preferably 0.045% or less.

The remainder of the chemical composition consists of Fe and impurities. The impurities mean components incorporated from raw materials such as ore or scrap or due to various factors of the manufacturing process when steel is industrially manufactured, and are acceptable within a range that does not adversely affect the present invention. Furthermore, the base steel piece of the electrical steel sheet according to the present embodiment may contain other elements, for example, one or more selected from the group consisting of P, Cu, Ni, Sn, and Sb within the range that does not inhibit the characteristics of the electrical steel sheet according to the present embodiment.

P is an element that increases the electrical resistivity of the base steel sheet and contributes to a reduction of the iron loss. However, when the amount thereof exceeds 0.50%, the hardness increases excessively and the rolling characteristics deteriorate. Therefore, the amount thereof is preferably 0.50% or less. The amount thereof is more preferably 0.35% or less.

Cu (copper) is an element that forms fine CuS or CuSe that functions as an inhibitor and contributes to the improvement in the magnetic characteristics. However, when the amount thereof exceeds 0.40%, the effect of improving the magnetic characteristics is saturated and surface defects are incurred during hot rolling. Therefore, the amount thereof is preferably 0.40% or less. The amount thereof is more preferably 0.35% or less.

Ni (nickel) is an element that increases the electrical resistivity of the base steel sheet and contributes to a reduction of the iron loss. However, when the amount thereof exceeds 1.00%, secondary recrystallization becomes unstable. Therefore, the amount of Ni is preferably 1.00% or less. The amount thereof is more preferably 0.75% or less.

Sn and Sb are elements that segregate at grain boundaries and have a function of adjusting the oxidation behavior during decarburization annealing. However, when the amount thereof exceeds 0.30%, decarburization does not easily proceed during the decarburization annealing, so that the amounts of both Sn and Sb are preferably 0.30% or less. The amounts of both the elements are more preferably 0.25% or less.

Furthermore, the base steel piece may adjunctively contain one or more selected from the group consisting of Cr, Mo, V, Bi, Nb, and Ti as an element forming an inhibitor. The lower limits of these elements are not particularly limited, and may be each 0%. The upper limits of these elements may be 0.30%, 0.10%, 0.15%, 0.010%, 0.20%, and 0.0150%, respectively.

Next, methods for specifying the configuration of the grain-oriented electrical steel sheet according to the present embodiment will be described below. Moreover, for convenience, methods for evaluation elements other than the constituent elements of the grain-oriented electrical steel sheet according to the present embodiment are also described.

A test piece is cut out of the grain-oriented electrical steel sheet in which the insulation coating is formed, and the layering structure of the test piece is observed with a scanning electron microscope (SEM) or a transmission electron microscope (TEM).

Specifically, first, a test piece is cut out so that the cutting direction is parallel to the thickness direction (specifically, the test piece is cut out so that the cross section is parallel to the thickness direction and perpendicular to the rolling direction), and the cross-sectional structure of this cross section is observed with an SEM at a magnification at which each layer is included in the observed visual field. For example, in observation with a reflection electron composition image (COMP image), it can be inferred how many layers does the cross-sectional structure include. For example, in the COMP image, the steel sheet can be distinguished as light color, the intermediate layer as dark color, and the insulation coating as intermediate color.

In order to identify each layer in the cross-sectional structure, line analysis is performed along the thickness direction using SEM-EDS (energy dispersive X-ray spectroscopy), and quantitative analysis of the chemical composition of each layer is performed. The elements to be quantitatively analyzed are five elements Fe, P, Si, O, and Mg.

From the observation results in the COMP image and the quantitative analysis results of SEM-EDS, when an area has a Fe content of 80 at % or more excluding the measurement noise, and the line segment (thickness) on the scanning line of the line analysis corresponding to this area is 300 nm or more, the area is determined as the base steel sheet, and an area excluding the base steel sheet is determined as the intermediate layer and the insulation coating. In addition, the "measurement noise" is noise in the graph showing the line analysis results.

Regarding the area excluding the base steel sheet identified above, from the observation results in the COMP image and the quantitative analysis results of SEM-EDS, when an area has a Fe content of less than 80 at % excluding the measurement noise, a P content of 5 at % or more excluding the measurement noise, a Si content of less than 20 at % excluding the measurement noise, an O content of 50 at % or more excluding the measurement noise, and a Mg content of 10 at % or less excluding the measurement noise, and the line segment (thickness) on the scanning line of the line analysis corresponding to this area is 300 nm or more, the area is determined as the insulation coating.

In addition, in order to determine the area which is the insulation coating, precipitates, inclusions, and the like which are contained in the insulation coating are not considered as determination objects, but the area that satisfies the quantitative analysis results as a primary phase is determined as the insulation coating. For example, when the presence of precipitates, inclusions, and the like on the scanning line of the line analysis is confirmed from the COMP image or the line analysis results, this area is not considered as an object, and the insulation coating is determined by the quantitative analysis results as a primary phase. The precipitates and inclusions can be distinguished from the primary phase by contrast in the COMP image, and can be distinguished from the primary phase by the abundance of constituent elements included in the quantitative analysis results.

When an area excludes the base steel sheet and the insulation coating identified above and the line segment (thickness) on the scanning line of the line analysis corresponding to this area is 300 nm or more, this area is determined as the intermediate layer.

The identification of each layer and the measurement of the thickness by the COMP image observation and SEM-EDS quantitative analysis are performed on five or more points while changing the observed visual field. For the thicknesses of the intermediate layer and the insulation coating obtained at a total of five or more points, an average value is obtained from values excluding the maximum value and the minimum value, and this average value is taken as the average thickness of the intermediate layer and the average thickness of the insulation coating.

In addition, if a layer in which the line segment (thickness) on the scanning line of the line analysis is less than 300 nm is included in at least one of the five or more observed visual fields described above, the layer is observed in detail by the TEM, and the identification of the corresponding layer and the measurement of the thickness are performed by the TEM.

A test piece including a layer to be observed in detail using the TEM is cut out so that the cutting direction is parallel to the thickness direction (specifically, a test piece is cut out so that the cross section is parallel to the thickness direction and perpendicular to the rolling direction), and the cross-sectional structure of this cross section is observed (bright-field image) with a scanning-TEM (STEM) at a magnification at which the corresponding layer is included in the observed visual field.

In order to identify each layer in the cross-sectional structure, line analysis is performed along the thickness direction using TEM-EDS, and quantitative analysis of the chemical composition of each layer is performed. The elements to be quantitatively analyzed are five elements Fe, P, Si, O, and Mg.

From the observation results of the bright-field image by the TEM described above and the quantitative analysis results of TEM-EDS, each layer is identified and the thickness of each layer is measured.

An area having a Fe content of 80 at % or more excluding the measurement noise is determined as the base steel sheet, and an area excluding this base steel sheet is determined as the intermediate layer and the insulation coating.

Regarding the area excluding the base steel sheet identified above, from the observation results in the COMP image and the quantitative analysis results of TEM-EDS, an area having a Fe content of less than 80 at % excluding the measurement noise, a P content of 5 at % or more excluding the measurement noise, a Si content of less than 20 at % excluding the measurement noise, an O content of 50 at % or more excluding the measurement noise, and a Mg content of 10 at % or less excluding the measurement noise is determined as the insulation coating. In addition, in order to determine the area which is the insulation coating, precipitates, inclusions, and the like which are contained in the insulation coating are not considered as determination objects, but the area that satisfies the quantitative analysis results as a primary phase is determined as the insulation coating.

An area excluding the base steel sheet and the insulation coating identified above is determined as the intermediate layer.

The line segment (thickness) on the scanning line of the line analysis is measured for the intermediate layer and the insulation coating identified above. When the thickness of each layer is 5 nm or less, it is preferable to use a TEM having a spherical aberration correction function from the viewpoint of spatial resolution. When the thickness of each layer is 5 nm or less, point analysis is performed at intervals of 2 nm along the thickness direction, the line segment (thickness) of each layer is measured, and this line segment may be adopted as the thickness of each layer.

The observation and measurement with the TEM are performed on five or more points while changing the observed visual field. For the measurement results obtained at a total of five or more points, an average value is obtained from values excluding the maximum value and the minimum value, and this average value is adopted as the average thickness of the corresponding layer.

In addition, the amounts of Fe, P, Si, O, Mg, and the like contained in the base steel sheet, the intermediate layer, and the insulation coating described above are a criterion for identifying the base steel sheet, the intermediate layer, and the insulation coating. The chemical compositions of the base steel sheet, the intermediate layer, and the insulation coating of the electrical steel sheet according to the present embodiment are not particularly limited.

Next, it is confirmed whether or not a metal phosphide is included in the intermediate layer identified above.

Based on the identification results described above, a test piece including the intermediate layer is cut out so that the cutting direction is parallel to the thickness direction (specifically, the test piece is cut out so that the cross section is parallel to the thickness direction and perpendicular to the rolling direction), and the cross-sectional structure of this cross section is observed with the TEM at a magnification at which the intermediate layer is included in the observed visual field.

Precipitate phases included in the intermediate layer are confirmed from a total of five or more random bright field images, identification of crystalline phases is performed from the analysis of the crystal structure by electron beam diffraction for the precipitate phases, and the elements are confirmed by point analysis by TEM-EDS.

Specifically, electron beam diffraction is performed on the precipitate phases as the object with a narrowed electron beam so as to obtain information from only the precipitate phases as the object, and the crystal structure of the crystalline phases as the object is identified from the electron beam diffraction pattern. This identification may be performed using the Powder Diffraction File (PDF) of the International Centre for Diffraction Data (ICDD). From the electron beam diffraction results, it can be basically determined whether the crystalline phase is $Fe_3P$, $Fe_2P$, FeP, $FeP_2$, Fe, or $Fe_2SiO_4$.

In addition, identification of whether the crystalline phase is $Fe_3P$ may be performed based on PDF: No. 01-089-2712. Identification of whether the crystalline phase is $Fe_2P$ may be performed based on PDF: No. 01-078-6749. Identification of whether the crystalline phase is FeP may be performed based on PDF: No. 03-065-2595. Identification of whether the crystalline phase is $FeP_2$ may be performed based on PDF: No. 01-089-2261. When the crystalline phase is identified based on the PDF described above, the identification may be performed with an interplanar spacing tolerance of ±5% and an interplanar angle tolerance of ±3°.

As a result of the point analysis by TEM-EDS, when the P content of the crystalline phase as the object is 30 at % or more and the total amount of the P content and the amount of metal elements is 70 at % or more, this crystalline phase can be confirmed as the metal phosphide. When the crystalline phase as the object has a P content of less than 30 at % and a Fe content of 70 at % or more, this crystalline phase can be confirmed as a iron. When the crystalline phase as the object has a P content of less than 30 at %, a Fe content of 10 at % or more, and a Si content of 5 at % or more, this crystalline phase can be confirmed as iron silicate.

At least five crystalline phases for each point, a total of 25 crystalline phases are identified and confirmed.

In addition, the area fraction of the metal phosphide is obtained by image analysis based on the intermediate layer identified above and the metal phosphide identified above. Specifically, the area fraction of the metal phosphide is obtained from the total cross-sectional area of the intermediate layer present in the area subjected to the electron beam irradiation in a total of five or more observed visual fields, and the total cross-sectional area of the metal phosphide present in the intermediate layer. For example, a value obtained by dividing the total cross-sectional area of the metal phosphide by the total cross-sectional area of the intermediate layer is adopted as the average area fraction of the metal phosphide. Regarding image binarization for image analysis, image binarization may be performed by manually coloring the intermediate layer and the metal phosphide in the photograph based on the above-described identification result of the metal phosphide.

In addition, based on the metal phosphide identified above, the equivalent circle diameter of the metal phosphide is obtained by image analysis. The equivalent circle diameters of at least five or more metal phosphides in each of a total of five or more observed visual fields are obtained, an average value excluding the maximum value and the minimum value is obtained from the obtained equivalent circle diameters, and this average value is adopted as the average equivalent circle diameter of the metal phosphide. Regarding image binarization for image analysis, image binarization may be performed by manually coloring the metal phosphide in the photograph based on the above-described identification result of the metal phosphide.

The surface roughness of a steel sheet can be measured using a stylus type surface roughness measuring device based on JIS B 0633:2001. Here, when a material steel sheet before the intermediate layer and the insulation coating are formed is available, the material steel sheet may be used as a measurement object. On the other hand, when only a grain-oriented electrical steel sheet in which the intermediate layer and the insulation coating are formed is available, the above-described measurement may be performed after the insulation coating is appropriately removed by a known method. Since the thickness of the intermediate layer is small, it is considered that this does not affect the surface roughness measurement result of the steel sheet. Therefore, removal of the intermediate layer is not essential.

The coating adhesion of the insulation coating is evaluated by conducting a bending adhesion test. A 80 mm×80 mm flat plate-shape test piece as a grain-oriented electrical steel sheet is wound around a round bar with a diameter of 20 mm and is stretched flat, the area of the insulation coating that is not peeled off from the electrical steel sheet is measured, a value obtained by dividing the area that is not peeled off by the area of the steel sheet is defined as the area fraction of remained coating (%), and the coating adhesion of the insulation coating is evaluated. For example, calculation may be performed by placing a transparent film with a 1-mm grid scale on the test piece and measuring the area of the insulation coating that is not peeled off.

Next, a method of manufacturing the grain-oriented electrical steel sheet according to the present embodiment will be described. According to the findings of the present inventors, in the method of manufacturing the grain-oriented electrical steel sheet according to the present embodiment described below, the grain-oriented electrical steel sheet according to the present embodiment described above can be manufactured. However, even in a grain-oriented electrical steel sheet obtained by a manufacturing method other than the method of manufacturing the electrical steel sheet according to the present embodiment, when the above requirements are satisfied, an intermediate layer containing silicon oxide as a main component (that is, an intermediate layer containing Si and O) capable of securing excellent coating adhesion of an insulation coating without unevenness is formed. Therefore, the grain-oriented electrical steel sheet that satisfies the above requirements is the grain-oriented electrical steel sheet according to the present embodiment regardless of the manufacturing method.

Figure 4:
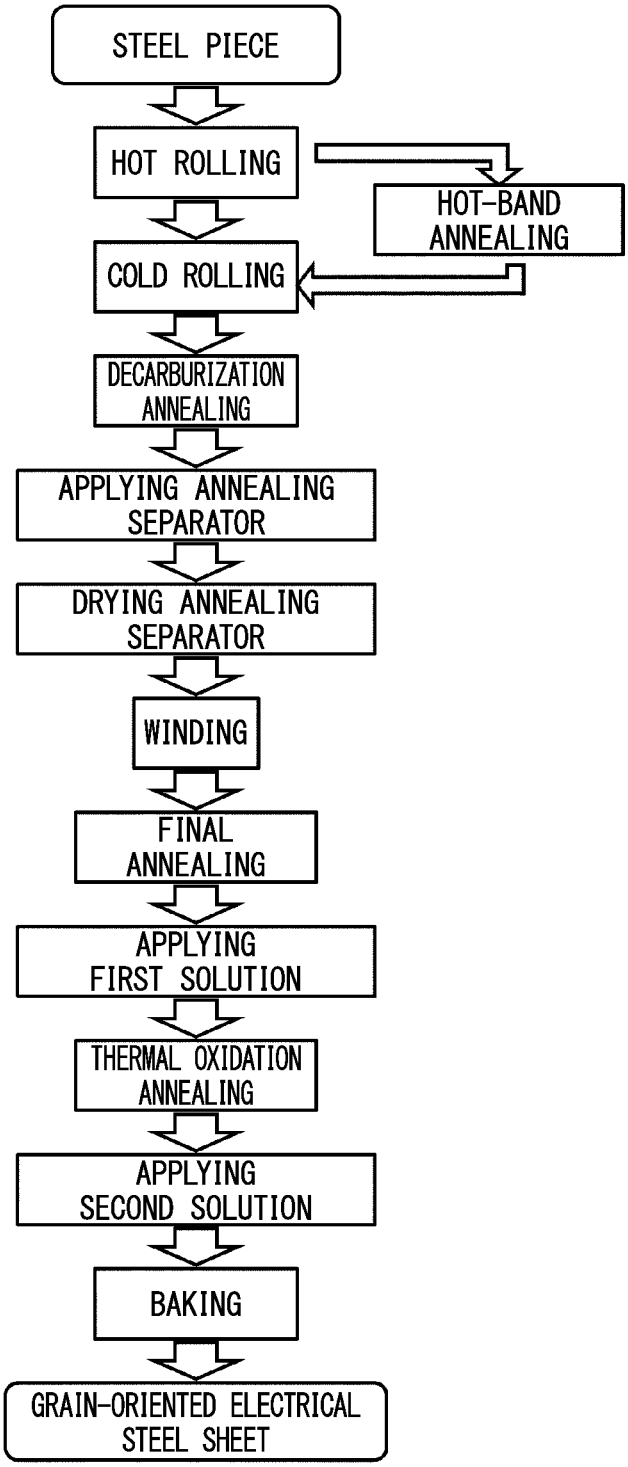
FIG. 4 is a view showing a method of manufacturing the grain-oriented electrical steel sheet of the present invention.

The method of manufacturing the electrical steel sheet according to the present embodiment (hereinafter sometimes referred to as the "manufacturing method according to the present embodiment") includes: as shown in FIG. 4, hot rolling a steel piece to obtain a hot-rolled steel sheet; annealing the hot-rolled steel sheet as necessary; cold rolling the hot-rolled steel sheet to obtain a cold-rolled steel sheet; decarburization annealing the cold-rolled steel sheet to form an oxide layer on the surface of the cold-rolled steel sheet; applying an annealing separator onto the surface of the cold-rolled steel sheet having the oxide layer; drying the annealing separator and winding the cold-rolled steel sheet; final annealing the wound cold-rolled steel sheet; applying a first solution; further annealing the cold-rolled steel sheet to which the first solution is applied to form an intermediate layer containing a metal phosphide (thermal oxidation annealing); applying a second solution on the surface of the intermediate layer; and baking the cold-rolled steel sheet to which the second solution is applied, in which the first solution contains phosphoric acid and a metal compound, the mass ratio between the phosphoric acid and the metal compound is 2:1 to 1:2, in the annealing for forming the intermediate layer, the annealing temperature is 600° C. to 1150° C., the annealing time is 10 to 600 seconds, the dew point in the annealing atmosphere is −20° C. to 2° C., and the ratio between the amount of hydrogen and the amount of nitrogen in the annealing atmosphere is 75%:25%, and the application amount of the first solution is controlled such that the abundance of the metal phosphide included is 1% to 30% by cross-sectional area fraction in a cross section of the intermediate layer. The method of manufacturing the grain-oriented electrical steel sheet may further include removing an inorganic mineral material film generated during the final annealing before the applying of the first solution, in which the annealing separator may contain magnesia as a main component. Particularly, it is important for the method of manufacturing the electrical steel sheet according to the present embodiment that the solution (first solution) containing phosphoric acid and a compound containing a metal element that reacts with the phosphoric acid to produce the metal phosphide is applied onto (a) the surface of the grain-oriented electrical steel sheet from which an inorganic mineral material film such as forsterite generated on the surface of the steel sheet during final annealing is removed by pickling, grinding, or the like, or (b) the surface of the grain-oriented electrical steel sheet in which the generation of the inorganic mineral material film is suppressed during final annealing, and is annealed to form the intermediate layer containing silicon oxide as a main component and containing the metal phosphide and the solution (second solution) containing a phosphate and colloidal silica as a main component is applied onto the intermediate layer and baked to form an insulation coating.

The grain-oriented electrical steel sheet from which the inorganic mineral material film such as forsterite is removed by pickling, grinding, or the like, and the grain-oriented electrical steel sheet in which the generation of the oxide layer of the inorganic mineral material is suppressed, are manufactured, for example, as follows.

A silicon steel piece containing 2.0 to 4.0 mass % of Si is hot-rolled into a hot-rolled steel sheet, the hot-rolled steel sheet is subjected to annealing as necessary, the hot-rolled steel sheet or the annealed hot-rolled steel sheet is thereafter subjected to one cold rolling or two or more times of cold rolling with intermediate annealing therebetween and finished to a steel sheet having a final thickness, and the steel sheet is then subjected to decarburizing annealing to cause primary recrystallization to proceed. An oxide layer is formed on the surface of the steel sheet by the decarburization annealing. Although the annealing (so-called hot-band annealing) of the hot-rolled steel sheet is not essential, the annealing may be performed to improve product characteristics.

Next, an annealing separator containing magnesia as a main component is applied onto the surface of the steel sheet having the oxide layer, and dried. After the drying, the resultant is wound into a coil, and subjected to final annealing (secondary recrystallization). During the final annealing, a forsterite film containing forsterite ($Mg_2SiO_4$) as a main component is formed on the surface of the steel sheet, but the film is removed by pickling, grinding, or the like. After the removal, preferably, the surface of the steel sheet is finished smooth by chemical polishing or electrolytic polishing. When the surface roughness of the steel sheet becomes 0.5 μm or less in arithmetic average roughness Ra by chemical polishing or electrolytic polishing, the iron loss characteristics of the grain-oriented electrical steel sheet are significantly improved, which is preferable.

Next, an annealing separator containing alumina as a main component can be used instead of the annealing separator containing magnesia, and this is applied and dried. After the drying, the resultant is wound into a coil, and subjected to final annealing (secondary recrystallization). During the final annealing, the generation of an inorganic mineral material film such as forsterite is suppressed, and a grain-oriented electrical steel sheet can be produced. After the production, preferably, the surface of the steel sheet is finished smooth by chemical polishing or electrolytic polishing.

The solution (first solution) containing phosphoric acid and the compound containing the metal element that reacts with the phosphoric acid to produce the metal phosphide is applied onto the surface of the grain-oriented electrical steel sheet from which the inorganic mineral material film such as forsterite is removed, or the surface of the grain-oriented electrical steel sheet in which the generation of the inorganic mineral material film such as forsterite is suppressed, and is annealed to form the intermediate layer according to the present embodiment.

Examples of sources of the metal of the metal phosphide (that is, compounds containing the metal element) include chlorides, sulfates, carbonates, nitrates, phosphates, simple metals. However, as the metal phosphide, one or more selected from the group consisting of $Fe_3P$, $Fe_2P$, and FeP are preferable from the viewpoint of securing good adhesion to the steel sheet. Therefore, the compound containing the metal element that reacts with the phosphoric acid to produce the metal phosphide is preferably a compound containing Fe. In view of reactivity with phosphoric acid, $FeCl_3$ is preferable. In a case of using an organic phosphoric acid or phosphate as a source of phosphorus in the metal phosphide, there is concern that the amount of metal phosphide may be insufficient. Therefore, the first solution needs to contain phosphoric acid.

The ratio between the phosphoric acid in the first solution to be applied and the compound containing the metal element that reacts with the phosphoric acid to form the metal phosphide is adjusted to be 2:1 to 1:2, and preferably 1:1 to 1:1.5 by mass ratio. By causing the ratio between the phosphoric acid and the compound containing the metal element to be within the above range, the adhesion of the insulation coating can be sufficiently improved. When the phosphoric acid is insufficient, no metal phosphide is formed in the intermediate layer.

The application amount of the first solution is determined according to the thickness of the intended intermediate layer. The amount of the metal phosphide itself in the intermediate layer is determined by the application amount of the phosphoric acid and the compound containing the metal element. On the other hand, the thickness of the intermediate layer is determined by the annealing temperature, the annealing time, and the dew point of the annealing atmosphere, as described later. Therefore, the cross-sectional area fraction in a cross section of the intermediate layer of the metal phosphide is determined by both the application amount of the compound and the annealing conditions. For the above reasons, it is necessary to determine the application amount of the first solution according to the thickness of the intermediate layer. For example, when annealing is performed under the condition that the thickness of the intermediate layer is 4 nm, the application amount of the first solution may be 0.03 to 4 $mg/m^2$. When annealing is performed under the condition that the thickness of the intermediate layer is less than 400 nm, the application amount of the first solution may be 3 to 400 $mg/m^2$. The application amount of the first solution is the application amount of the phosphoric acid and the compound containing the metal element, and the mass of water or the like as these solvents is not included in the application amount of the first solution.

The annealing for forming the intermediate layer according to the present embodiment may be retained at a temperature at which the metal phosphide is generated for a required time, and is not particularly limited to a specific temperature and retention time. However, from the viewpoint of promoting the reaction of the compound containing the metal element that produces the metal phosphide with phosphoric acid, the annealing temperature is preferably 600° C. to 1150° C. When the compound containing the element for producing the metal phosphide is $FeCl_3$, the annealing temperature is preferably 700° C. to 1150° C. The annealing time is preferably 10 to 600 seconds.

The annealing atmosphere is preferably a reducing atmosphere so as not to cause the inside of the steel sheet to be oxidized, and is particularly preferably a nitrogen atmosphere in which hydrogen is mixed. For example, an atmosphere containing hydrogen:nitrogen at 75%:25% and having a dew point of −20° C. to 2° C. is preferable. In addition, the atmosphere may be controlled focusing on the oxidation potential. In this case, the annealing atmosphere is preferably set such that the oxygen partial pressure ($P_{H2O}/P_{H2}$: ratio of water vapor partial pressure to hydrogen partial pressure) is in a range of 0.0016 to 0.0093.

The abundance of the metal phosphide included in the intermediate layer according to the present embodiment is preferably 1% to 30% by cross-sectional area fraction in the cross section of the intermediate layer according to the present embodiment. The cross-sectional area fraction thereof is more preferably 5% to 25%. The intermediate layer according to the present embodiment may contain α-Fe and/or iron silicate in addition to the metal phosphide. α-Fe is produced by the reduction of an iron compound, and iron silicate is produced by the redox reaction of α-Fe or an iron compound and silicon oxide.

Even when the intermediate layer according to the present embodiment contains α-Fe and/or iron silicate as appropriate in addition to the metal phosphide, the abundance of these materials included is preferably 1% to 30% by cross-sectional area fraction in the cross section of the intermediate layer according to the present embodiment. The cross-sectional area fraction thereof is more preferably 5% to 25%.

The thickness of the intermediate layer according to the present embodiment is set by adjusting one or more of the annealing temperature, retention time, and the dew point of the annealing atmosphere. The thickness of the intermediate layer according to the present embodiment is preferably 4 to 400 nm. The thickness thereof is more preferably 5 to 300 nm. The thickness of the intermediate layer becomes larger as the annealing temperature is higher, the retention time is longer, and the dew point of the annealing atmosphere is higher. In the temperature range and the atmosphere range described above, the thickness of the intermediate layer is set to a predetermined value by adjusting one or more of the annealing temperature, the retention time, and the dew point of the annealing atmosphere which are control factors of the thickness.

The cooling of the steel sheet after annealing, that is, the cooling of the intermediate layer according to the present embodiment is performed while maintaining the oxidation behavior of the annealing atmosphere low so that the metal phosphide does not chemically change. For example, the cooling is performed in an atmosphere containing hydrogen: nitrogen at 75%:25% and having a dew point of −50° C. to −20° C.

A sol-gel method may be used as a method of forming the intermediate layer according to the present embodiment. For example, a silica gel in which a phosphorus compound is dissolved in a water-alcohol solvent is applied onto the surface of the steel sheet, is heated to 200° C. to be dried in air, and after the drying, is retained at 300 to 1000° C. for one minute in a reducing atmosphere to be air-cooled.

The grain size of the metal phosphide, and α-Fe and/or iron silicate contained in the intermediate layer according to the present embodiment is preferably 1 nm or more. The grain size is more preferably 3 nm or more. On the other hand, the grain size thereof is preferably ⅔ or less of the thickness of the intermediate layer according to the present embodiment. More preferably, the grain size thereof is ½ or less of the thickness of the intermediate layer according to the present embodiment. Although the factors affecting the grain size of the metal phosphide, and α-Fe and/or iron silicate are not clear at present, the grain size tends to increase as the annealing temperature is raised and the retention time is lengthened. In addition, the grain size of the metal phosphide tends to increase as the ratio between the phosphoric acid in the first solution and the compound containing the metal element that reacts with the phosphoric acid to form the metal phosphide decreases (that is, the ratio of the amount of the phosphoric acid to the amount of the compound decreases). It is considered that a preferable grain size can be obtained by adjusting one or more of these control factors.

The second solution containing a phosphate and colloidal silica as a main component is applied onto the intermediate layer according to the present embodiment and baked, for example, at 850° C. to form a phosphoric acid-based insulation coating. A known method can be suitably used as the control method of the thickness of the insulation coating. For example, the thickness of the insulation coating can be controlled by changing the application amount of the second solution containing a phosphate and colloidal silica as a main component.

The coating adhesion of the insulation coating is evaluated by conducting a bending adhesion test. The grain-oriented electrical steel sheet is wound around a round bar with a diameter of 20 mm and is thereafter unwound flat, the area of the insulation coating that is not peeled off from the steel sheet is measured, the ratio of the area to the area of the steel sheet:area fraction of remained coating (%) is calculated, and the coating adhesion of the insulation coating is evaluated.

EXAMPLES

Next, examples of the present invention will be described, but the conditions in the examples are example conditions adopted for confirming the feasibility and effects of the present invention, so that the present invention is not limited to the example conditions. The present invention can adopt various conditions as long as the object of the present invention is achieved without departing from the gist of the present invention. In addition, evaluation of each of the examples described below was implemented by the evaluation method described above.

Example 1

A silicon steel piece having the composition shown in Table 1 was soaked at 1150° C. for 60 minutes and then subjected to hot rolling to obtain a 2.3 mm-thick hot-rolled steel sheet. Next, the hot-rolled steel sheet was subjected to annealing in which the hot-rolled steel sheet was retained at 1120° C. for 200 seconds, immediately retained at 900° C. for 120 seconds and rapidly cooled, and then was subjected to cold rolling after picking, thereby forming a cold-rolled steel sheet having a final thickness of 0.23 mm.

TABLE 1

| | Composition (mass %) | | | | | |
|---|---|---|---|---|---|---|
| Base steel piece | Si | C | Al | Mn | S | N |
| A | 3.20 | 0.061 | 0.029 | 0.090 | 0.006 | 0.008 |

The cold-rolled steel sheet (hereinafter referred to as "steel sheet") was subjected to decarburization annealing at 850° C. for 180 seconds in an atmosphere containing hydrogen:nitrogen at 75%:25%. The steel sheet after the decarburization annealing was subjected to nitriding annealing retained at 750° C. for 30 seconds in a mixed atmosphere of hydrogen, nitrogen, and ammonia to adjust the nitrogen content of the steel sheet to 230 ppm.

An annealing separator containing alumina as a main component was applied to the steel sheet after the nitriding annealing, and thereafter the steel sheet was subjected to final annealing by being heated to 1200° C. at a heating rate of 15° C./hr in a mixed atmosphere of hydrogen and nitrogen, then subjected to purification annealing by being retained at 1200° C. for 20 hours in a hydrogen atmosphere, and naturally cooled, whereby a grain-oriented electrical steel sheet having a smooth surface was produced. The arithmetic average roughness Ra of this grain-oriented electrical steel sheet was 0.21 μm.

An aqueous solution containing the applied material shown in Table 2 was applied onto the smooth surface of the produced grain-oriented electrical steel sheet so that the amount of the applied material excluding water became the application amount shown in Table 2, and the resultant was heated to 1000° C. at a heating rate of 8° C./s in an atmosphere containing hydrogen:nitrogen at 75%:25% and having a dew point of −20° C. and after the heating retained for 60 seconds by immediately changing the dew point to −5° C. The ratio between the phosphoric acid and the compound containing a metal element in all the applied materials shown in Table 2 was in a range of 2:1 to 1:2 by mass ratio. After the retention, the dew point of the atmosphere was immediately changed to −50° C. for natural cooling.

During the heating and natural cooling, the dew point of the atmosphere was set to be low to suppress the oxidation reaction. In particular, during the natural cooling, the dew point of the atmosphere was kept low in order to suppress the chemical change in the metal phosphide in the intermediate layer containing silicon oxide as a main component. During the isothermal retention, the dew point of the atmosphere was kept high in order to form the intermediate layer containing silicon oxide as a main component. In this manner, on the surface of the grain-oriented electrical steel sheet, the intermediate layer containing silicon oxide as a main component and containing the metal phosphide, and α-Fe and/or iron silicate was formed. The thicknesses of the formed intermediate layers are collectively shown in Table 2.

An aqueous solution containing magnesium phosphate, colloidal silica, and chromic anhydride as a main component was applied onto the surface of the formed intermediate layer, and baked at 850° C. for 30 seconds in a nitrogen atmosphere to form an insulation coating.

A test piece was cut out from the grain-oriented electrical steel sheet in which the insulation coating was formed, the cross section thereof was observed with a transmission electron microscope, and the thickness of the intermediate layer and the total cross-sectional area fraction of the materials contained in the intermediate layer were measured. The element ratio between the material as a main component contained in the intermediate layer and the materials contained in the intermediate layer was identified by energy dispersive X-ray spectroscopy, and furthermore, the materials contained in the intermediate layer were identified by electron beam diffraction. The results are also shown in Table 2.

Next, a 80 mm×80 mm test piece was cut out from the grain-oriented electrical steel sheet in which the insulation coating was formed, and wound around a round bar with a diameter of 20 mm and stretched flat, the area of the insulation coating that had not peeled off from the steel sheet was measured, and the area fraction of remained coating was calculated. A sample having an area fraction of remained coating of 85% or more was determined to have good adhesion, and a sample having 90% or more was determined to have even better adhesion. The results are also shown in Table 2.

The material as a main component contained in the intermediate layer is silicon oxide. In the intermediate layer of Test Piece A3, $Fe_2P$, FeP, α-Fe, and $Fe_2SiO_4$ were included. These materials are considered to be formed from Fe of the applied material $FeCl_3$, and from P of the phosphoric acid of the applied material, and Si and O of silicon oxide as the main component of the intermediate layer. In addition, the grain sizes (average value of equivalent circle diameters) of the metal phosphide of all the test pieces disclosed in Table 2 were in a range of 1 nm or more and ⅔ or less of the thickness of the intermediate layer.

While the area fraction of remained coating of Test Piece A1 in which the intermediate layer did not contain a phosphide, α-Fe, and $Fe_2SiO_4$ was 81%, the area fraction of

TABLE 2

| Test Piece | Applied material | Application amount ($mg/m^2$) | Thickness of intermediate layer (nm) | Materials contained in intermediate layer | Total cross-sectional area fraction of materials (%) | Area fraction of remained coating (%) | Note |
|---|---|---|---|---|---|---|---|
| A1 | Absent | 0 | 58 | Absent | 0 | 81 | Comparative Example |
| A2 | Phosphoric acid | 4 | 63 | Absent | 0 | 84 | Comparative Example |
| A3 | $FeCl_3$<br>Phosphoric acid | 4<br>4 | 67 | $Fe_2P$, FeP, α-Fe, and $Fe_2SiO_4$ | 11 | 97 | Invention Example |
| A4 | $CoCl_2$<br>Phosphoric acid | 4<br>4 | 64 | $Co_2P$ | 10 | 87 | Invention Example |
| A5 | $NiCl_2$<br>Phosphoric acid | 4<br>4 | 66 | $Ni_2P$ | 8 | 89 | Invention Example |
| A6 | $CuCl_2$<br>Phosphoric acid | 4<br>4 | 65 | $Cu_3P$ | 9 | 88 | Invention Example |
| A21 | $FeCl_3$<br>Magnesium Phosphate | 4<br>4 | 65 | $Fe_2P$, FeP, α-Fe, and $Fe_2SiO_4$ | 0.8 | 83 | Comparative Example |
| A22 | $FeCl_3$<br>Calcium Phosphate | 4<br>4 | 68 | $Fe_2P$, FeP, α-Fe, and $Fe_2SiO_4$ | 0.7 | 82 | Comparative Example |

remained coating of Test Piece A3 in which the intermediate layer contained $Fe_2P$, FeP, α-Fe, and $Fe_2SiO_4$ was 97%. From this, it can be seen that when intermediate layer containing silicon oxide as a main component contains a Fe phosphide, the coating adhesion of the insulation coating is significantly improved.

The area fraction of remained coating of Test Pieces A4 to A6 in which the intermediate layer containing silicon oxide as a main component contained $Co_2P$, $Ni_2P$, and $Cu_3P$ was 90% or less, and it can be seen that $Co_2P$, $Ni_2P$, and $Cu_3P$ do not contribute as much as $Fe_2P$ and FeP to the improvement in the coating adhesion of the insulation coating. However, compared to Test Piece A2, the coating adhesion was improved, and then an intermediate layer containing $Co_2P$, $Ni_2P$, and $Cu_3P$ is also an invention example.

Example 2

As in Example 1, a grain-oriented electrical steel sheet having a smooth surface was produced. An aqueous solution containing the applied material shown in Table 3 was applied onto the surface of the grain-oriented electrical steel sheet so that the amount of the applied material excluding water became the application amount shown in Table 3, and the resultant was heated to 1150° C. at a heating rate of 8° C./s in an atmosphere containing hydrogen:nitrogen at 75%:25% and having a dew point of −20° C. The ratio between the phosphoric acid and the compound containing a metal element in all the applied materials shown in Table 3 was in a range of 2:1 to 1:2 by mass ratio.

After the heating, the dew point of the atmosphere was immediately changed to −3° C. for retention for the retention time shown in Table 3, and after the retention, the dew point of the atmosphere was immediately changed to −30° C. to form an intermediate layer on the smooth surface of the steel sheet. After the formation, the resultant was subjected to natural cooling.

As in Example 1, an insulation coating was formed on the intermediate layer, and thereafter the material as a main component contained in the intermediate layer and the materials contained in the intermediate layer were identified, and furthermore, the total cross-sectional area fraction of the materials and the area fraction of remained coating of the insulation coating were measured. The results are shown in Table 3. The grain sizes (average value of equivalent circle diameters) of the metal phosphide of all the test pieces disclosed in Table 3 were in a range of 1 nm or more and ⅔ or less of the thickness of the intermediate layer.

TABLE 3

| Test Piece | Applied material | Application amount ($mg/m^2$) | Retention time (sec) | Thickness of intermediate layer (nm) | Materials contained in intermediate layer | Total cross-sectional area fraction of materials (%) | Area fraction of remained coating (%) | Note |
|---|---|---|---|---|---|---|---|---|
| A7 | $FeCl_3$<br>Phosphoric acid | 8<br>8 | 10 | 74 | $Fe_2P$, FeP, α-Fe, and $Fe_2SiO_4$ | 13 | 93 | Invention Example |
| A8 | $FeCl_3$<br>Phosphoric acid | 8<br>8 | 50 | 163 | $Fe_2P$, FeP, α-Fe, and $Fe_2SiO_4$ | 7 | 94 | Invention Example |
| A9 | $FeCl_3$<br>Phosphoric acid | 8<br>8 | 150 | 286 | $Fe_2P$, α-Fe, and $Fe_2SiO_4$ | 4 | 91 | Invention Example |
| A10 | $FeCl_3$<br>Phosphoric acid | 8<br>8 | 300 | 393 | $Fe_2P$, α-Fe, and $Fe_2SiO_4$ | 3 | 90 | Invention Example |
| A11 | $FeCl_3$<br>Phosphoric acid | 8<br>8 | 600 | 583 | $Fe_2P$, α-Fe, and $Fe_2SiO_4$ | 2 | 87 | Invention Example |

The material as a main component contained in the intermediate layer was silicon oxide. While the area fraction of remained coating of Test Piece A11 in which the thickness of the intermediate layer was as large as 583 nm was less than 90%, the area fraction of remained coating of Test Pieces A7 to A10 in which the thickness of the intermediate layer was 400 nm or less was 90% or more. As described above, the thickness of the intermediate layer is preferably 400 nm or less. However, Test Piece A11 in which the thickness of the intermediate layer exceeded 400 nm had an area fraction of remained coating of more than 85%, which is an acceptance criterion and was thus also determined as an invention example.

Example 3

As in Example 1, a grain-oriented electrical steel sheet having a smooth surface was produced. An aqueous solution containing the applied material shown in Table 4 was applied onto the surface of the grain-oriented electrical steel sheet so that the amount of the applied material excluding water became the application amount shown in Table 4, and the resultant was heated to 700° C. at a heating rate of 6° C./s in an atmosphere containing hydrogen:nitrogen at 75%:25% and having a dew point of −20° C. The ratio between the phosphoric acid and the compound containing a metal element in all the applied materials shown in Table 4 was in a range of 2:1 to 1:2 by mass ratio.

After the heating, the dew point of the atmosphere was immediately changed to 1° C. for retention for the retention time shown in Table 4, and after the retention, the dew point of the atmosphere was immediately changed to −40° C. to form an intermediate layer on the smooth surface of the steel sheet. After the formation, the resultant was subjected to natural cooling.

As in Example 1, an insulation coating was formed on the intermediate layer, and thereafter the material as a main component contained in the intermediate layer and the materials contained in the intermediate layer were identified, and furthermore, the total cross-sectional area fraction of the materials and the area fraction of remained coating of the insulation coating were measured. The results are shown in Table 4. The grain sizes (average value of equivalent circle diameters) of the metal phosphide of all the test pieces disclosed in Table 4 were in a range of 1 nm or more and ⅔ or less of the thickness of the intermediate layer.

TABLE 4

| Test Piece | Applied material | Application amount ($mg/m^2$) | Retention time (sec) | Thickness of intermediate layer (nm) | Materials contained in intermediate layer | Total cross-sectional area fraction of materials (%) | Area fraction of remained coating (%) | Note |
|---|---|---|---|---|---|---|---|---|
| A12 | $FeCl_3$<br>Phosphoric acid | 0.1<br>0.1 | 10 | 3 | $Fe_2P$, FeP | 4 | 83 | Comparative Example |
| A13 | $FeCl_3$<br>Phosphoric acid | 0.1<br>0.1 | 50 | 8 | $Fe_2P$, $Fe_3P$ | 2 | 90 | Invention Example |
| A14 | $FeCl_3$<br>Phosphoric acid | 0.1<br>0.1 | 100 | 11 | $Fe_2P$, $Fe_3P$ | 1.6 | 93 | Invention Example |
| A15 | $FeCl_3$<br>Phosphoric acid | 0.1<br>0.1 | 300 | 21 | $Fe_2P$, $Fe_3P$ | 1.1 | 95 | Invention Example |
| A16 | $FeCl_3$<br>Phosphoric acid | 0.1<br>0.1 | 600 | 29 | $Fe_2P$, $Fe_3P$ | 0.6 | 65 | Comparative Example |

The material as a main component contained in the intermediate layer was silicon oxide. The materials contained in the intermediate layer were $Fe_2P$, $Fe_3P$, and/or FeP, and α-Fe and $Fe_2SiO_4$ could not be detected. It is considered that this is because the annealing retention temperature for forming the intermediate layer was as low as 700° C. and α-Fe and $Fe_2SiO_4$ were not generated.

While the area fraction of remained coating of Test Piece A12 in which the thickness of the intermediate layer was less than 4 nm was less than 90%, the area fraction of remained coating of Test Pieces A13 to A15 in which the thickness of the intermediate layer was 8 to 21 nm was 90% or more. As described above, it can be seen that when the thickness of the intermediate layer is 4 nm or more, a grain-oriented electrical steel sheet having superior coating adhesion is obtained.

In addition, while the area fraction of remained coating of Sample A16 in which the total cross-sectional area fraction of the materials included in the intermediate layer was 0.6% was less than 90%, the area fraction of remained coating was 90% or more in a case of Samples A13 to A15 in which the total cross-sectional area fraction of the materials included in the intermediate layer was 1% or more. As described above, it can be seen that when the total cross-sectional area fraction of the materials included in the intermediate layer is 1% or more, a grain-oriented electrical steel sheet having superior adhesion is obtained.

Example 4

A silicon steel piece (slab) having the composition shown in Table 1 was soaked at 1150° C. for 60 minutes and then subjected to hot rolling to obtain a 2.3 mm-thick hot-rolled steel sheet. Next, the hot-rolled steel sheet was subjected to annealing in which the hot-rolled steel sheet was retained at 1120° C. for 200 seconds, immediately retained at 900° C. for 120 seconds and rapidly cooled, and thereafter subjected to cold rolling after picking, thereby forming a cold-rolled steel sheet having a final thickness of 0.27 mm.

The cold-rolled steel sheet (hereinafter referred to as "steel sheet") was subjected to decarburization annealing at 850° C. for 180 seconds in an atmosphere containing hydrogen:nitrogen at 75%:25%. The steel sheet after the decarburization annealing was subjected to nitriding annealing retained at 750° C. for 30 seconds in a mixed atmosphere of hydrogen, nitrogen, and ammonia to adjust the nitrogen content of the steel sheet to 230 ppm.

An annealing separator containing magnesia as a main component was applied to the steel sheet after the nitriding annealing, and thereafter the steel sheet was subjected to final annealing by being heated to 1200° C. at a heating rate of 15° C./hr in a mixed atmosphere of hydrogen and nitrogen, then subjected to purification annealing by being retained at 1200° C. for 20 hours in a hydrogen atmosphere. Thereafter, the steel sheet after the purification annealing was naturally cooled.

The forsterite film containing forsterite as a main component, which was formed on the surface of the steel sheet, was removed by pickling, and then subjected to electrolytic polishing after the removal, thereby forming a grain-oriented electrical steel sheet having a smooth surface. The arithmetic average roughness Ra of this grain-oriented electrical steel sheet was 0.14 μm.

An aqueous solution containing the applied material shown in Table 5 was applied onto the surface of the grain-oriented electrical steel sheet so that the amount of the applied material excluding water became the application amount shown in Table 5, and the resultant was heated to 800° C. at a heating rate of 6° C./s in an atmosphere containing hydrogen:nitrogen at 75%:25% and having a dew point of −20° C. After the heating, the dew point of the atmosphere was immediately changed to −1° C. for retention for the retention time shown in Table 5, and after the retention, the dew point of the atmosphere was immediately changed to −50° C. to form an intermediate layer on the smooth surface. After the formation, the resultant was subjected to natural cooling. The ratio between the phosphoric acid and the compound containing a metal element in all the applied materials shown in Table 5 was in a range of 2:1 to 1:2 by mass ratio.

As in Example 1, an insulation coating was formed on the intermediate layer, and thereafter the material as a main component contained in the intermediate layer and the materials contained in the intermediate layer were identified, and furthermore, the total cross-sectional area fraction of the materials and the area fraction of remained coating of the insulation coating were measured. The results are shown in Table 5. The grain sizes (average value of equivalent circle diameters) of the metal phosphide of all the test pieces disclosed in Table 5 were in a range of 1 nm or more and ⅔ or less of the thickness of the intermediate layer.

TABLE 5

| Test Piece | Applied material | Application amount ($mg/m^2$) | Retention time (sec) | Thickness of intermediate layer (nm) | Materials contained in intermediate layer | Total cross-sectional area fraction of materials (%) | Area fraction of remained coating (%) | Note |
|---|---|---|---|---|---|---|---|---|
| A17 | $FeCl_3$<br>Phosphoric acid | 30<br>20 | 40 | 39 | $Fe_2P$, FeP, α-Fe, and $Fe_2SiO_4$ | 63 | 57 | Comparative Example |
| A18 | $FeCl_3$<br>Phosphoric acid | 15<br>10 | 50 | 36 | $Fe_2P$, FeP, α-Fe, and $Fe_2SiO_4$ | 28 | 90 | Invention Example |
| A19 | $FeCl_3$<br>Phosphoric acid | 7<br>5 | 60 | 30 | $Fe_2P$, α-Fe, and $Fe_2SiO_4$ | 15 | 94 | Invention Example |
| A20 | $FeCl_3$<br>Phosphoric acid | 4<br>3 | 70 | 31 | $Fe_2P$, α-Fe, and $Fe_2SiO_4$ | 7 | 93 | Invention Example |

The material as a main component contained in the intermediate layer was silicon oxide. While the area fraction of remained coating of Test Piece A17 in which the total cross-sectional area fraction of the materials contained in the intermediate layer was 63% was less than 90%, the area fraction of remained coating of Test Pieces A18 to A20 in which the total cross-sectional area fraction of the materials contained in the intermediate layer was 30% or less was 90% or more. As described above, it can be seen that when the total cross-sectional area fraction of the materials contained in the intermediate layer is 30% or less, a grain-oriented electrical steel sheet having superior coating adhesion is obtained.

INDUSTRIAL APPLICABILITY

As described above, according to the present invention, it is possible to provide a grain-oriented electrical steel sheet in which an intermediate layer containing silicon oxide as a main component, which contains a metal phosphide, and α-Fe and/or iron silicate as appropriate and can secure excellent coating adhesion of an insulation coating without unevenness, is provided on the entire surface of the steel sheet, and a method of manufacturing the same. Therefore, the industrial applicability of the present invention is high in the electrical steel sheet manufacturing and its utilization industry.

BRIEF DESCRIPTION OF THE REFERENCE SYMBOLS

1 steel sheet
2 forsterite film
3 insulation coating
4 intermediate layer
5 metal phosphide

The invention claimed is:

1. A grain-oriented electrical steel sheet comprising:
a steel sheet;
an intermediate layer containing Si and O, arranged on the steel sheet; and
an insulation coating arranged on the intermediate layer,
wherein the intermediate layer contains a metal phosphide,
a thickness of the intermediate layer is 4 nm or more, and
an abundance of the metal phosphide included is 1% to 30% by cross-sectional area fraction in a cross section of the intermediate layer.

2. The grain-oriented electrical steel sheet according to claim 1,
wherein the metal phosphide is a Fe phosphide which is one or more selected from the group consisting of $Fe_3P$, $Fe_2P$, and FeP.

3. The grain-oriented electrical steel sheet according to claim 1,
wherein the intermediate layer contains an α-Fe and/or an iron silicate in addition to the metal phosphide.

4. The grain-oriented electrical steel sheet according to claim 3,
wherein a total abundance of the metal phosphide, and the α-Fe and/or the iron silicate included is 1% to 30% by cross-sectional area fraction in the cross section of the intermediate layer.

5. The grain-oriented electrical steel sheet according to claim 1,
wherein the thickness of the intermediate layer is less than 400 nm.

6. The grain-oriented electrical steel sheet according to claim 1,
wherein a thickness of the insulation coating is 0.1 μm to 10 μm.

7. The grain-oriented electrical steel sheet according to claim 1,
wherein a surface roughness of the steel sheet is 0.5 μm or less by arithmetic average roughness Ra.

8. A method of manufacturing the grain-oriented electrical steel sheet according to claim 1, the method comprising:
hot rolling a steel piece to obtain a hot-rolled steel sheet;
cold rolling the hot-rolled steel sheet to obtain a cold-rolled steel sheet;
decarburization annealing the cold-rolled steel sheet to form an oxide layer on a surface of the cold-rolled steel sheet;
applying an annealing separator onto the surface of the cold-rolled steel sheet having the oxide layer;
drying the annealing separator and winding the cold-rolled steel sheet;

final annealing the wound cold-rolled steel sheet;

applying a first solution;

further annealing the cold-rolled steel sheet to which the first solution is applied to form an intermediate layer containing a metal phosphide;

applying a second solution on a surface of the intermediate layer; and baking the cold-rolled steel sheet to which the second solution is applied, wherein the first solution contains phosphoric acid and a metal compound, and a mass ratio between the phosphoric acid and the metal compound is 2:1 to 1:2, in the annealing for forming the intermediate layer, an annealing temperature is 600° C. to 1150° C., an annealing time is 10 to 600 seconds, a dew point in an annealing atmosphere is −20° C. to 2° C., and a ratio between an amount of hydrogen and an amount of nitrogen in the annealing atmosphere is 75%:25%, and an application amount of the first solution is controlled such that an abundance of the metal phosphide included is 1% to 30% by cross-sectional area fraction in a cross section of the intermediate layer thereby producing the grain-oriented electrical steel sheet of claim 1.

9. The method of manufacturing the grain-oriented electrical steel sheet according to claim 8, further comprising:

removing an inorganic mineral material film generated by the final annealing before the applying of the first solution, wherein the annealing separator contains magnesia as a main component.

10. The method of manufacturing the grain-oriented electrical steel sheet according to claim 8, further comprising:

annealing the hot-rolled steel sheet before the cold rolling.

* * * * *